US006445115B1

(12) United States Patent
Lae

(10) Patent No.: US 6,445,115 B1
(45) Date of Patent: Sep. 3, 2002

(54) ELECTRODE OF ELECTRON GUN AND ELECTRON GUN USING THE SAME

(75) Inventor: Cho Seog Lae, Pusan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 254 days.

(21) Appl. No.: 09/598,969

(22) Filed: Jun. 22, 2000

(30) Foreign Application Priority Data

Jun. 23, 1999 (KR) ..... 99-23814

(51) Int. Cl.[7] ..... H01J 29/50
(52) U.S. Cl. ..... 313/414; 313/412
(58) Field of Search ..... 313/414, 412, 313/447, 452, 453

(56) References Cited

U.S. PATENT DOCUMENTS 6,236,153 B1 * 5/2001 Kim ..... 313/414
6,246,166 B1 * 6/2001 Bae et al. ..... 313/446
6,342,758 B1 * 1/2002 Nakamura et al. ..... 313/414

* cited by examiner

*Primary Examiner*—Robert H. Kim
*Assistant Examiner*—Jurie Yun
(74) *Attorney, Agent, or Firm*—Lowe Hauptman Gilman & Berner, LLP

(57) ABSTRACT

An electrode of an electron gun, and an electron gun for a cathode ray tube are provided. The electron gun includes a first electrode member having supporting portions protruding from both edges thereof along a lengthwise direction, and three connection holes disposed in an in-line arrangement, and second electrode members connected to the connection holes of the first electrode member, and each having a plane portion where electron beam passing holes are formed, and a flange portion formed along the periphery of the plane portion and connected to the periphery of each connection hole of the first electrode member.

16 Claims, 5 Drawing Sheets

ELECTRODE OF ELECTRON GUN AND ELECTRON GUN USING THE SAME

BACKGROUND OF THE INVENTION

1. Field of the Invention

The present invention relates to an electron gun for a cathode ray tube (CRT), and more particularly, to an electrode having an improved structure and an electron gun using the same.

2. Description of the Related Art

In general, an electron gun for a color CRT is mounted within the neck portion of the CRT and emits electron beams for irradiating a fluorescent layer. As shown in FIG. 1, the electron gun includes a cathode structure 11, a control electrode 12 and a screen electrode 13 together constituting a triode section, and a plurality of focusing electrodes 14 constituting a main lens.

In the electron gun for a color CRT having the above-described configuration, as predetermined voltages are applied to the respective electrodes, electron beams emitted from an electron emitting material of the cathode structure 11 are focused and accelerated by electronic lenses formed among the respective electrodes and selectively deflected according to the scanning position of the fluorescent layer to then land on the fluorescent layer.

Such an electron gun for a color CRT is provided with static converging means and focusing means, for changing paths of three electron beams emitted from a cathode individually or wholly in the course of accelerating and focusing the electron beams, thereby achieving precision of convergence. However, the static convergence action of the electron beams is weakened by several causes including processing errors occurring while manufacturing the respective electrodes 11 through 14 constituting the electron gun, deformation of electrodes which is caused by an external force applied when fixing the electrodes in a bead glass, a shift in the positions of electron beam passing holes which is caused by thermal expansion of electrodes, and the like.

In particular, the triode section consisting of the cathode structure 11, the control electrode 12 adjacent thereto and the screen electrode 13, is subjected to heat treatment for heating an electron emitting material so that a thermal drift phenomenon of electron beams occurs due to thermal deformation, resulting in a convergence drift, and a cross-over point related to an objective point of an electron beam is formed. Thus, it is necessary to accurately control the size of an electron beam passing hole and the thickness of an electrode in the electron beam passing hole portion.

FIG. 2 illustrates an example of a plate-shaped electrode which functions as a control electrode or a screen electrode.

Referring to FIG. 2, an electrode 20 made of a single plate includes three electron beam passing holes RH, GH and BH formed on a plate-shaped main body 21 in an in-line arrangement, and depressions 22*a*, 22*b* and 22*c* which are disposed around the electron beam passing holes RH, GH and BH, for thinning the portions where the electron beam passing holes RH, GH and BH are formed. Also, beads 23*a*, 23*b* and 23*c* for reinforcing the strength of the electrode portions around the electron beam passing holes RH, GH and BH are formed around the depressions 22*a*, 22*b* and 22*c*. A plane portion 24 is disposed around the beads 23*a*, 23*b* and 23*c*, and supporting portions 25 which are embedded in a bead glass (not shown), for supporting the electrode 20, are formed at edges of the main body 21 along a lengthwise direction thereof. Also, assembly holes 26 for aligning the electron beam passing holes RH, GH and BH are provided at both sides of the main body 21 along the horizontal axis thereof.

Since the aforementioned electrode 20 for an electron gun has three electron beam passing holes RH, GH and BH formed in its main body 21 of a single plate in an in-line arrangement, it is very important to uniformly form pitches P and P' among the electron beam passing holes RH, GH and BH. The electron beam passing holes RH, GH and BH are formed by punching. In the case of forming the central electron beam passing hole and the side electron beam passing holes, the processing error in the pitch is ±0.005. That is, a high-precision processing technique is required for forming the electron beam passing holes within the error allowance.

Also, in the aforementioned electrode 20, the assembly holes 26 must maintain a difference of ±0.005 mm in the processing eccentricity. A difference in the thickness between the portions of the electron beam passing holes RH, GH and BH, which is caused by the depressions 22*a*, 22*b* and 22*c*, must be within the range of ±0.005 mm. However, as described above, since the single-plated electrode 20 is formed by a single mold, if a predetermined portion of the mold bears a difference beyond the allowance, the mold cannot function properly. Thus, maintenance of the predetermined portion is difficult to achieve, and the productivity is then lowered.

In the aforementioned conventional electrode 20, since the beads 23*a*, 23*b* and 23*c* and the depressions 22*a*, 22*b* and 22*c* are formed in an in-line arrangement in its main body 21 which is elongated horizontally, the areas of flat portions around the electron beam passing holes RH, GH and BH are not constant. In such a state, if the electrode 20 is heated at 980 to 1050° C. for 8 to 10 minutes for the purpose of performing a hydrogen-reduction process for removing gases in the metal of the plate, the electrode 20 may be deformed due to asymmetrical processing stress and anisotropic shape stress.

In particular, since the plate-shaped electrode 20 is used as a control electrode installed to be adjacent to a cathode structure, the electrode 20 experiences thermal expansion due to heat generated from a heater of the cathode structure, as shown in FIG. 3. The thermal expansion shifts the positions of the electron beam passing holes RH, GH and BH formed in an in-line arrangement, relative to each other, to cause a thermal drift by which paths of the electron beams passing through the electron beam passing holes are shifted, which lowers the white-balancing characteristics and resolution of the CRT.

SUMMARY OF THE INVENTION

To solve the above problems, it is an object of the present invention to provide an electrode of an electron gun, which can improve precision of processing and productivity, and can prevent thermal drift of electron beams and improve focusing and white-balancing characteristics by preventing deformation of the electrode due to heat transfer from a heater of a cathode structure, and an electron gun for a cathode ray tube using the electrode.

It is another object of the present invention to provide an electrode of an electron gun including a first electrode member having supporting portions protruding from both edges thereof along a lengthwise direction, and three connection holes disposed in an in-line arrangement, and second electrode members connected to the connection holes of the first electrode member, and each having a plane portion where electron beam passing holes are formed, and a flange portion formed along the periphery of the plane portion and connected to the periphery of each connection hole of the first electrode member.

In the present invention, depressions are preferably formed by press-molding peripheries of the electron beam passing holes formed in the plane portion, and a bead is preferably formed between the plane portion and the flange portion.

Here, the shapes of the electron beam passing holes may be circular, elliptical or polygonal. Also, the weight of the central second electrode member may be different from that of either side second electrode member.

According to another aspect of the present invention, there is provided an electron gun for a cathode ray tube, the electron gun having a cathode, a control electrode and a screen electrode together constituting a triode section, and a plurality of focusing electrodes sequentially installed from the screen electrode, wherein the control electrode or the screen electrode includes a first electrode member having supporting portions protruding from both edges of the control electrode or the screen electrode along a lengthwise direction and having three connection holes disposed in an in-line arrangement, and second electrode members connected to the connection holes of the first electrode member, and each having a plane portion where electron beam passing holes are formed, and a flange portion formed along the periphery of the plane portion and connected to the periphery of each connection hole of the first electrode member.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
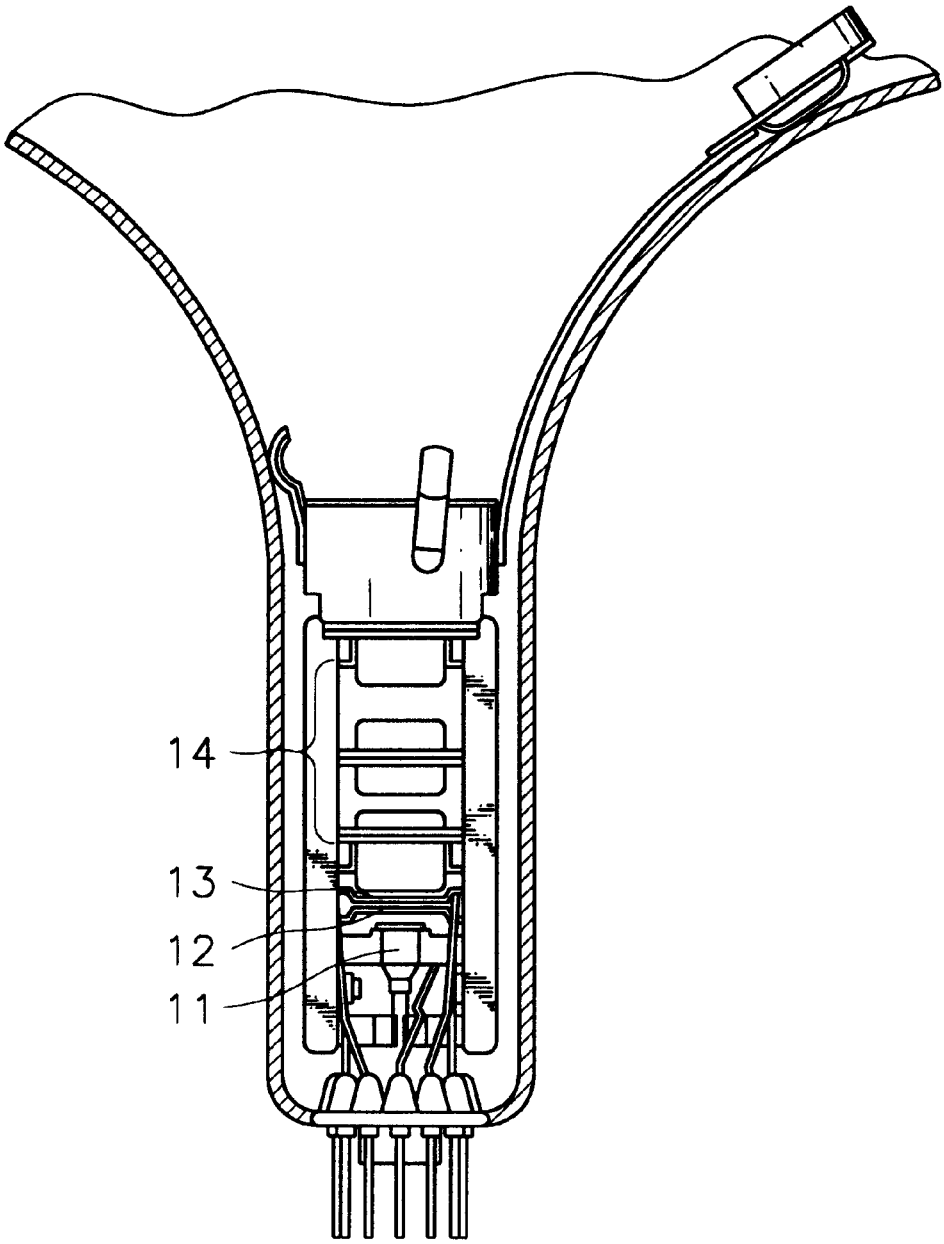
FIG. 1 (PRIOR ART)
FIG. 1 is a diagram illustrating a state where an electron gun is mounted within a neck portion.
Figure 2:
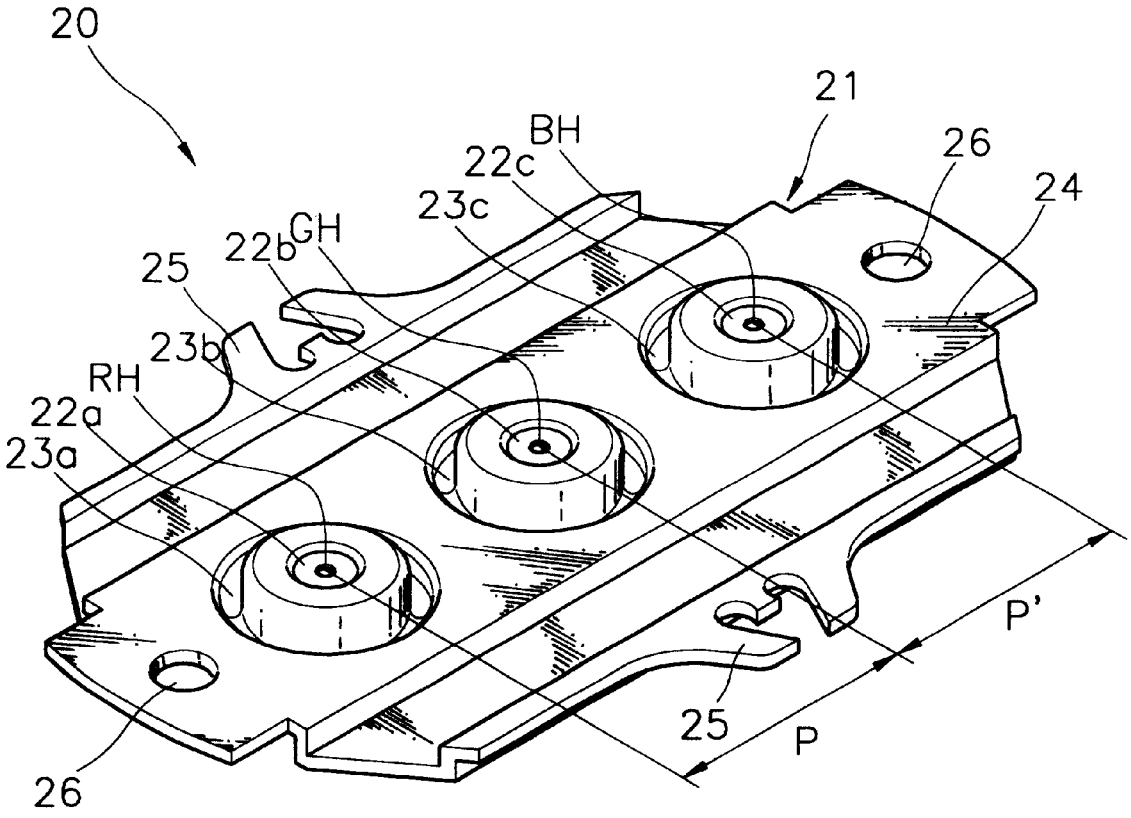
FIG. 2 (PRIOR ART)
FIG. 2 is a perspective view illustrating a conventional electrode.
Figure 3:
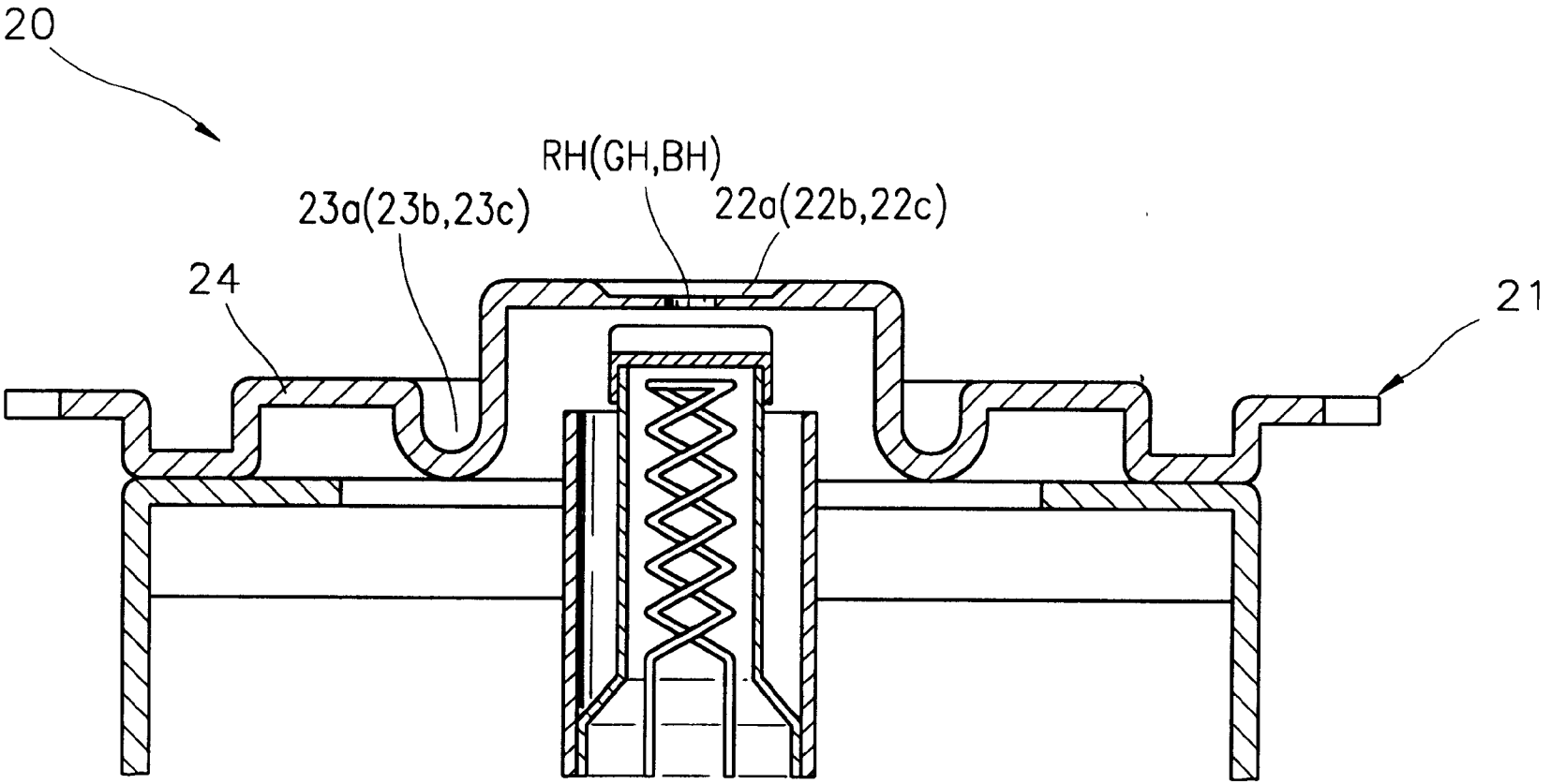
FIG. 3 (PRIOR ART)
FIG. 3 is a cross-sectional view illustrating a state where the conventional electrode shown in FIG. 2 is employed to an electron gun.
Figure 4:
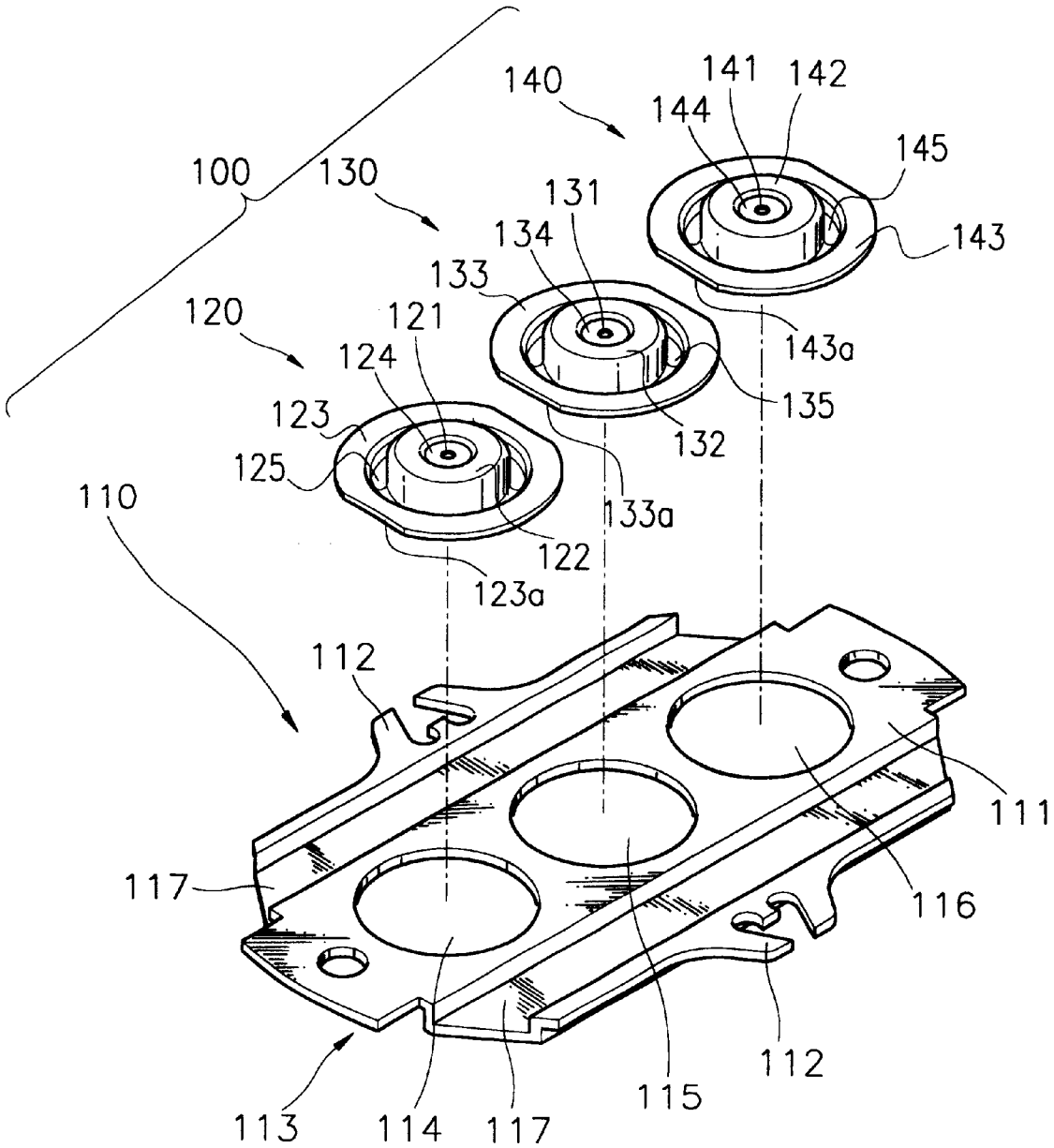
FIG. 4 is an exploded perspective view illustrating an electrode of an electron gun according to the present invention.
Figure 5:
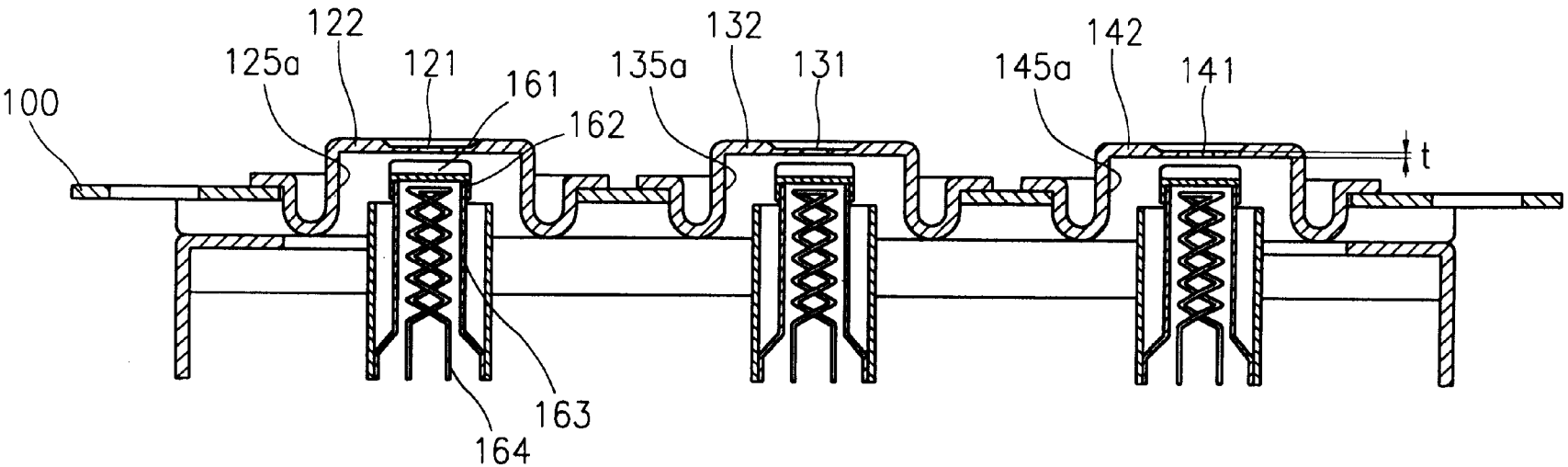
FIG. 5 is a cross-sectional view illustrating a cathode structure and an electrode according to the present invention.

As shown in FIGS. 1, 4 and 5, an electron gun for a cathode ray tube (CRT) includes a cathode structure 11 for emitting thermions, a control electrode 12, a screen electrode 13 and a plurality of focusing electrodes 14 for focusing and accelerating electron beams. Among the electrodes constituting the electron gun, the control electrode 12 adjacent to the cathode structure 11 and the screen electrode 13 are plate-shaped.

An electrode 100 which functions as the control electrode 12 includes a first electrode member 110 which is buried in a bead glass (not shown) and forms a major part of the electrode 100, and three second electrode members 120, 130 and 140 which are connected to the first electrode member 110 and each of which has an electron beam passing hole.

The first electrode member 110 has a plane portion 111 and a main body 113 having supporting portions 112 buried in the bead glass at both edges of the first electrode member 110. Three connection holes 114, 115 and 116 are formed in the plane portion 111 of the main body 113 in an in-line arrangement. Each reinforcement portion 117 for releasing or reinforcing precision of a heating process or the strength of assembly, is formed at both edges of the plane portion 111 adjacent to the supporting portions 112 along a lengthwise direction of the main body 113. The shape of the reinforcement portion 117 is not restricted to that described in this embodiment, and various changes and modifications may be effected in view of strengthening the electrode and precision of a heating process.

The second electrode members 120, 130 and 140 are connected to the connection holes 114, 115 and 116 of the first electrode member 110 and are constructed as follows.

The second electrode members 120, 130 and 140 include plane portions 122, 132 and 142 having electron beam passing holes 121, 131 and 141 formed through mold-piercing and lamination, and flange portions 123, 133 and 143 which are formed along the peripheries of the plane portions 122, 132 and 142 to be connected to the peripheries of the connection holes 114, 115 and 116.

Electron beam passing holes 121, 131 and 141 formed in the plane portions 122, 132 and 142 have depressions 124, 134 and 144 formed by press-molding the peripheries thereof. The thickness t of a portion where each of the electron beam passing holes 121, 131 and 141 is formed may vary according to the depths of the depressions 124, 134 and 144. Here, it is necessary to maintain a deviation in the thickness of the electron beam passing hole portion to be within a predetermined allowance such that the depths of the depressions 124, 134 and 144 are kept constant. However, in consideration of positions where cross-over points of three electron beams are formed, the thicknesses of the electron beam passing hole portions of the three second electrode members 120, 130 and 140 may differ. Also, the shapes of the electron beam passing holes 121, 131 and 141 may be circular, elliptical or polygonal, and a combination thereof may be taken according to focusing characteristics of three electron beams.

Cutting portions 123*a*, 133*a* and 143*a* for reducing cross-sectional areas of the second electrode members 120, 130 and 140 are formed at both sides of or upper and lower portions thereof, thereby adjusting the weights of the second electrode members 120, 130 and 140 to then control each thermal expansion rate.

Beads 125, 135 and 145 are formed at the same distance from the center of each electron beam passing hole, between the plane portion 122 and the flange portion 123, between the plane portion 132 and the flange portion 133 and between the plane portion 142 and the flange portion 143, respectively, by a drawing or rounding process. As the beads 125, 135 and 145 are formed, the lengths of cylindrical portions 125*a*, 135*a* and 145*a* (see FIG. 5) are preferably 2.0 mm or less. Also, the plane portions 122, 132 and 142 and the flange portions 123, 133 and 143 must have an error allowance of ±0.002 mm or less due to a heating process in consideration of the structural precision thereof.

Also, in consideration of the heat capacity depending on the heating temperature of the three second electrode members 120, 130 and 140, the weight of the central second electrode member 130 is preferably equal to or greater than that of either side second electrode member 120 or 140. The difference in the weight may vary according to the kind of electron gun. Based on experiments by the present inventor, it has been shown that the preferred weight of a central second electrode member is equal to or less than 1.0 to 1.2 times than that of either side second electrode member.

The operation of the electron gun having the aforementioned configuration and the effects of the electrode thereof will now be described.

As shown in FIG. 5, in the electron gun for a color CRT according to the present invention, as a heater 164 installed inside a sleeve 163 for supporting base metal 162 coated with an electron emitting material 161 emits heat, the electron emitting material 161 is heated to then generate thermions. The thus-generated thermions, that is, electron beams, pass through a cathode lens formed between the electron beam passing holes 121, 131 and 141 of the plate-shaped electrode 100 which is a control electrode and the electron beam passing holes of the screen electrode 13 to produce cross-over points. The electron beams which produce cross-over points in such a manner are incident into focusing lenses including the main lens formed between the focusing electrodes 14 with a predetermined angle of incidence, focused and accelerated to then be deflected by a deflection yoke, thereby finally landing on a screen surface.

As described above, in the course of emitting the electron beams, since the electrode 100 is installed to be adjacent to the cathode structure 11, it is heated by a radiation heat emitted from the heater 164 to then be thermally expanded. Since the second electrode members 120, 130 and 140 having the electron beam passing holes 121, 131 and 141 are installed independently of the first electrode member 110, a shift in the positions of the electron beam passing holes 121, 131 and 141, which is due to the thermal expansion of the second electrode members 120, 130 and 140, can be reduced, thereby preventing a thermal drift of electron beams passing therethrough. In particular, since the cylindrical portions 125*a*, 135*a* and 145*a* produced by forming the beads 125, 135 and 145 in the second electrode members 120, 130 and 140 have a constant volume and are independent of each other, the emitted amount of the emitted electron beams can be maintained constant by adjusting the temperature of the cathode structure 11. Since the second electrode members 120, 130 and 140 having different weights have different heat capacities, a difference in the thermal expansion rate thereof, which is due to positions of the second electrode members 120, 130 and 140, that is, either center or either side, can be reduced.

The operational effects attainable in the course of manufacturing a plate-shaped electrode are as follows.

First, since second electrode members are separately fabricated and then fixed to a first electrode member, the processing precision of the first and second electrode members can be enhanced.

Second, since pitches among electron beam passing holes are determined by the precision of connection between the first electrode member and the second electrode members, the pitches can be accurately controlled.

Third, since the evenness of a plane portion where electron beam passing holes are formed and a plane portion of the first electrode member is separately controllable, and separate molds for the first electrode member and the second electrode members are used, the structures of molds can be simplified and the precision and productivity of molds can be improved.

As described above, in the electrode of an electron gun and the electron gun using the same according to the present invention, a plate-shaped electrode is separated into second electrode members having electron beam passing holes formed therein and a first electrode member by which the second electrode members are supported, thereby improving precision of a heating process. Further, deformation of the electrode due to a heating stress, a thermal drift due to thermal expansion of the electrode and a convergence drift occurring at a main lens system can be prevented.

While the present invention has been described in conjunction with the preferred embodiment disclosed, it will be apparent to those skilled in the art that various modifications and variations can be made within the spirit or scope of the invention. For example, the present invention can be applied to a plate-shaped electrode or a rim electrode of a screen electrode or a focusing electrode.

What is claimed is:

1. An electrode of an electron gun comprising:

a first electrode member having supporting portions protruding from both edges thereof along a lengthwise direction, and three connection holes disposed in an in-line arrangement; and second electrode members connected to the connection holes of the first electrode member, and each having a plane portion where electron beam passing holes are formed, and a flange portion formed along the periphery of the plane portion and connected to the periphery of each connection hole of the first electrode member.

2. The electrode according to claim 1, wherein depressions are formed by press-molding peripheries of the electron beam passing holes formed in the plane portion.

3. The electrode according to claim 1, wherein a bead is formed between the plane portion and the flange portion.

4. The electrode according to claim 1, wherein the shapes of the electron beam passing holes are circular, elliptical or polygonal.

5. The electrode according to claim 1, wherein the weight of the central second electrode member is different from that of either side second electrode member.

6. The electrode according to claim 5, wherein the weight of the central second electrode member is 1.0 to 1.2 times that of either side second electrode member.

7. The electrode according to claim 2, wherein the thicknesses of portions in the second electrode members, where the electron beam passing holes are formed, are different.

8. The electrode according to claim 3, wherein the length of a cylindrical portion produced by forming the bead around the plane portion is equal to or less than 2.0 mm.

9. An electron gun for a cathode ray tube, the electron gun having a cathode, a control electrode and a screen electrode together constituting a triode section, and a plurality of focusing electrodes sequentially installed from the screen electrode, wherein the control electrode or the screen electrode comprises:

a first electrode member having supporting portions protruding from both edges of the control electrode or the screen electrode along a lengthwise direction and having three connection holes disposed in an in-line arrangement; and second electrode members connected to the connection holes of the first electrode member, and each having a plane portion where electron beam passing holes are formed, and a flange portion formed along the periphery of the plane portion and connected to the periphery of each connection hole of the first electrode member.

10. The electron gun according to claim 9, wherein depressions are formed by press-molding peripheries of the electron beam passing holes formed in the plane portion.

11. The electron gun according to claim 9, wherein a bead is formed between the plane portion and the flange portion.

12. The electron gun according to claim 9, wherein the shapes of the electron beam passing holes are circular, elliptical or polygonal.

13. The electron gun according to claim 9, wherein the weight of the central second electrode member is different from that of either side second electrode member.

14. The electron gun according to claim 13, wherein the weight of the central second electrode member is 1.0 to 1.2 times that of either side second electrode member.

15. The electron gun according to claim 10, wherein the thicknesses of portions in the second electrode members, where the electron beam passing holes are formed, are different.

16. The electron gun according to claim 11, wherein the length of a cylindrical portion produced by forming the bead around the plane portion is equal to or less than 2.0 mm.

* * * * *